US009062549B2

(12) United States Patent
Pauwels et al.

(10) Patent No.: US 9,062,549 B2
(45) Date of Patent: Jun. 23, 2015

(54) FLUID INJECTED SCREW COMPRESSOR ELEMENT

(75) Inventors: Raphael Henri Maria Pauwels, Bornem (BE); Philippe Alphonse Louis Ernens, Aubel (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 394 days.

(21) Appl. No.: 12/919,837

(22) PCT Filed: May 15, 2009

(86) PCT No.: PCT/BE2009/000025

§ 371 (c)(1),
(2), (4) Date: Aug. 27, 2010

(87) PCT Pub. No.: WO2009/143589

PCT Pub. Date: Dec. 3, 2009

(65) Prior Publication Data

US 2011/0014079 A1 Jan. 20, 2011

(30) Foreign Application Priority Data

May 26, 2008 (BE) ..... 2008/0289

(51) Int. Cl.

| | |
|---|---|
| ***F01C 1/18*** | (2006.01) |
| ***F01C 1/24*** | (2006.01) |
| ***F04C 15/06*** | (2006.01) |

(Continued)

(52) U.S. Cl.

CPC ..... *F01C 21/02* (2013.01); *F04C 18/16* (2013.01); *F04C 2230/91* (2013.01); *F04C 2230/92* (2013.01); *F04C 2240/54* (2013.01)

(58) Field of Classification Search

CPC ..... F01C 21/02; F01C 21/16; F04C 18/16; F04C 2230/91; F04C 2230/93

USPC ..... 418/178, 189, 201.1, 206.6, 206.7, 418/206.8, 203.1, 179, 190

See application file for complete search history.

(56) References Cited

U.S. PATENT DOCUMENTS

| | | | | |
|---|---|---|---|---|
| 2,111,883 | A * | 3/1938 | Burghauser | 418/72 |
| 3,245,612 | A | 4/1966 | Nilsson et al. | |

(Continued)

FOREIGN PATENT DOCUMENTS

| | | |
|---|---|---|
| CH | 396289 A | 7/1965 |
| GB | 696008 A | 8/1953 |

(Continued)

OTHER PUBLICATIONS

International Search Report in PCT/BE2009/000025, Nov. 12, 2009.

*Primary Examiner* — Thomas Denion
*Assistant Examiner* — Jessica Kebea
(74) *Attorney, Agent, or Firm* — Bacon & Thomas, PLLC

(57) ABSTRACT

Fluid-injected screw-type compressor element comprising two co-operating rotors (2 and 3) which are radially and axially bearing-mounted in a housing (1), whereby this housing confines a rotor chamber (4) in which the rotors (2 and 3) are situated and in which a fluid circuit (11) for the injection of a fluid discharges, characterized in that the radial bearing of at least one rotor is formed by the contact of the rotor concerned with the part of the wall of the housing opposite the radial perimeter of the rotor concerned and/or the co-operation with the other rotor and by maximally one additional radial bearing.

15 Claims, 1 Drawing Sheet

(51) Int. Cl.

| | |
|---|---|
| ***F01C 21/02*** | (2006.01) |
| ***F01C 21/04*** | (2006.01) |
| ***F01C 21/10*** | (2006.01) |
| ***F01C 21/18*** | (2006.01) |
| ***F04C 18/16*** | (2006.01) |

(56) References Cited

U.S. PATENT DOCUMENTS

| | | | | |
|---|---|---|---|---|
| 5,350,286 | A * | 9/1994 | Kisi et al. | 418/150 |
| 5,957,676 | A * | 9/1999 | Peeters | 418/1 |
| 6,312,239 | B1 * | 11/2001 | Kirsten | 418/76 |
| 6,506,037 | B1 * | 1/2003 | Bush et al. | 418/178 |
| 2003/0126733 | A1 * | 7/2003 | Bush et al. | 29/458 |
| 2004/0086396 | A1 * | 5/2004 | De Smedt et al. | 417/372 |

FOREIGN PATENT DOCUMENTS

| | | |
|---|---|---|
| JP | 51030611 | 3/1976 |
| JP | 04342890 | 11/1992 |
| JP | 2003-519760 | 6/2003 |
| WO | 0151813 | 7/2001 |

* cited by examiner

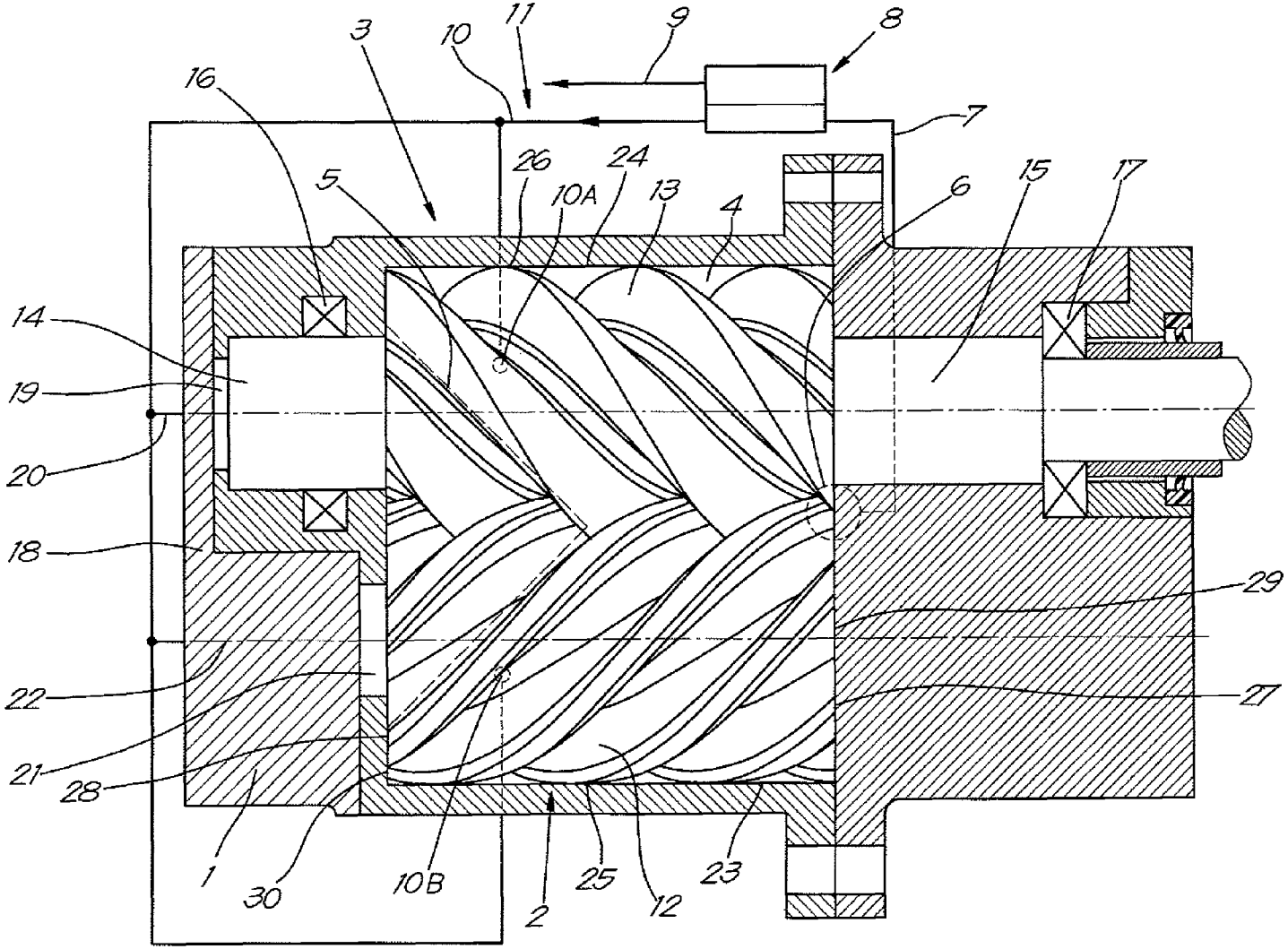
29
27
17
15
7
6
8
4
9
13
24
10A
26
11
10
3
5
16
14
19
20
18
22
21
28
1
30
10B
2
25
12
23

FLUID INJECTED SCREW COMPRESSOR ELEMENT

BACKGROUND OF THE INVENTION

A. Field

The present invention concerns a fluid-injected screw-type compressor element comprising two co-operating rotors which are bearing-mounted in a housing, whereby this housing confines a rotor chamber in which the rotors are situated and in which a fluid circuit for the injection of a fluid discharges.

B. Related Art

Fluid-injected screw-type compressor elements are generally known and work according to the known principle whereby the volume of the compression chambers which are formed between the teeth of the respective rotors meshing into one another gradually decreases while the rotors are turning.

After a certain rotation of the rotors, one of the compression chambers which is formed between the rotors is connected to the outlet of the screw-type compressor element.

Oil-injected screw-type compressor elements are already known at present whereby, for the lubrication, cooling and sealing of the rotors, oil with a relatively high kinematic viscosity of 30 to 70 cSt ($=3\cdot10^{-6}$ to $7\cdot10^{-6}$ $m^2/s$) at 40° C. according to ISO 46 is injected in the compression chamber.

The good working of such oil-injected screw-type compressor elements requires the use of radial and/or radial/axial roller bearings on either side of both rotors, so that said rotors can be mounted in a rotating manner in such a way that the friction between the rotors and the housing is restricted.

By roller bearings, or what are called anti-friction bearings, are understood bearings which are provided with roller elements which can be formed in various ways, such as in the shape of balls, tapered rollers, cones, cylinders, needles or the like.

The presence of such radial or radial/axial roller bearings is required among others to absorb radial forces exerted on the rotors during the compression, as well as the forces which are exerted on said rotors by the drive, for example in the form of gear wheels, belts or chains. Said roller bearings also make sure that the transmission of vibrations from the rotors to the housing is limited, which is good for the life span of the compressor and also to restrict any noise nuisance.

A disadvantage of such known screw-type compressor elements is that such roller bearings are usually expensive and relatively difficult to mount during the assembly of the screw-type compressor element.

Water-injected compressor elements are already known as well whereby, instead of oil, water is injected in the compression chamber with the same purpose, i.e. to provide for a cooling, lubrication and sealing.

With this type of water-injected screw-type compressor elements, the rotors are radially bearing-mounted with axle journals on either side in the housing by means of water-lubricated slide bearings comprising a corrosion-free bush, for example made of graphite, which bush extends between the respective axle journals of the rotors on the one hand, and the housing of the compressor element on the other hand.

A disadvantage of such water-injected compressor elements is that such water-lubricated slide bearings are usually expensive as the aforesaid bush is always made of a relatively expensive material and as said bearings require a high manufacturing tolerance of the bush.

Another disadvantage of such water-injected screw-type compressor elements is that they often have a relatively complex housing due to the presence of several injection channels for injecting water in the compression chamber and in the slide bearings.

An additional disadvantage of the known water-injected screw-type compressor elements is that the play of the rotors in the housing is relatively large, as a result of which leakage losses occur in the compression chamber between the mutual rotors and between the rotors and the wall of the rotor chamber, which leakage losses are partly absorbed by the injected fluid.

The present invention aims to remedy one or several of the above-mentioned and other disadvantages.

SUMMARY OF THE INVENTION

To this end, the invention concerns a fluid-injected screw-type compressor element comprising two co-operating rotors which are radially and axially bearing-mounted in a housing, whereby this housing confines a rotor chamber in which the rotors are situated and in which a fluid circuit for the injection of a fluid discharges, whereby this screw-type compressor element has the specific characteristic that the radial bearing of at least one rotor is realised by the direct contact of the rotor concerned with the part of the wall of the housing opposite the radial perimeter of the rotor concerned and/or by the co-operation with the other rotor and by maximally one additional radial bearing.

The aforesaid maximally one additional bearing may consist of a roller bearing or a slide bearing.

An advantage of such fluid-injected screw-type compressor element according to the invention is that, as the radial bearing of at least one rotor is realised by the housing and/or the co-operation with the other rotor, said at least one rotor is free of radial bearings on at least one axial rotor end, such that such fluid-injected screw-type compressor element can be made cheaper, simpler and more compact than conventional oil-injected screw-type compressor elements whereby both rotors are provided with radial or radial/axial roller bearings on either side.

Such a fluid-injected screw-type compressor element according to the invention can also be realised in a simpler and cheaper way than the known water-injected screw-type compressor elements whose rotors are provided with radial slide bearings on either side, since considerably less lubrication channels must be provided in the housing than in such water-injected screw-type compressor elements.

Another advantage of a fluid-injected screw-type compressor element according to the invention is that a bad alignment of the rotors is avoided during the mounting, since at least one rotor is radially bearing-mounted by the housing and/or by the co-operation with the other rotor.

Preferably, at least one of the aforesaid rotors is entirely free from any additional radial bearings, and the radial bearing of this at least one rotor is exclusively, realised by the housing and/or the co-operation with the other rotor.

This is advantageous in that the screw-type compressor element is further simplified, whereas the production and material costs are further lowered.

According to a preferred characteristic of the invention, the fluid-injected screw-type compressor element also comprises provisions to restrict any friction between the mutual rotors and/or between the rotors and the housing.

An advantage thereof is that the screw-type compressor element has a better efficiency than the conventional screw-type compressor elements and that the transmission of vibrations from the rotors to the housing is moreover restricted, which reduces the vibro-acoustic emission and promotes the life span of the screw-type compressor element.

In order to better, explain the characteristics of the invention, the following preferred embodiments of a fluid-injected screw-type compressor element according to the invention are described by way of example only without being limitative in any way, with reference to the accompanying FIGURE.

FIG. 1 schematically represents a section of a fluid-injected screw-type compressor element according to the invention.

DETAILED DESCRIPTION OF PREFERRED EMBODIMENT OF THE INVENTION

The fluid-injected screw-type compressor element which is represented in the FIGURE mainly consists of a housing 1 and two co-operating rotors, namely a female rotor 2 and a male rotor 3 provided in said housing 1.

The housing 1 encloses a rotor chamber 4 which is provided on one side, called the inlet side, with an inlet 5 with an inlet opening for the gas to be compressed and on the other side, called the outlet side, with an outlet 6 for the compressed gas and the injected fluid.

Onto this outlet 6 is connected an outlet line 7 which ends up in a fluid separator 8 in which opens a discharge line 9 for compressed gas at the top and onto which is connected a fluid line 10 at the bottom to carry back the separated fluid to the rotor chamber 4 in which said fluid line 10 opens via openings 10A and 10B.

The fluid separator 8 and the fluid line 10 are part of a fluid circuit 11. As a relatively high pressure, namely the outlet pressure, prevails in the outlet line 7 during normal operation of the screw-type compressor element, this outlet pressure will also prevail more or less in the fluid separator 8, and the fluid line 10 will form a part of the fluid circuit 11 in which the prevailing pressure is practically the same as the outlet pressure of the screw-type compressor element.

The female rotor 2 comprises a helical body 12 which, in the given example, is provided in the rotor chamber 4 without any axle journals and additional bearings in such a way that it can be directly rotated, whereas the male rotor 3 has a helical body 13 and, in this case, two axle journals 14 and 15 with which said male rotor is bearing-mounted in the housing 1 by means of two bearings 16 and 17 which each extend around an axle journal 14, 15 respectively.

According to the invention, the radial bearing of at least one rotor is realised by the contact, in particular more specifically the direct contact of the rotor concerned with the part 23 or 24 of the wall of the housing 1 opposite the radial perimeter 25 or 26 of the rotor concerned and/or the co-operation with the other rotor and by maximally one additional radial bearing, whereby this radial bearing may consist of a roller bearing or a slide bearing.

In the example of the FIGURE, the bearing of the female rotor 2 is exclusively realised by the housing 1 and the co-operation with the male rotor 3, without this female rotor being provided with additional radial bearings.

In particular, said female rotor 2 is free of bearing-mounted axle journals, and the radial bearing is exclusively guaranteed by the direct contact of the rotor 2 concerned with the part of the wall 21 of the housing 1 opposite the radial perimeter 25 of the rotor 2 concerned and the co-operation with the male rotor 3, and thus without any additional radial bearings being required, whereas the axial bearing of the female rotor 2 is exclusively guaranteed by the contact between an end face 27 or 28 of the female rotor 2 concerned and the opposite part 29 or 30 of the wall of the housing 2, without any additional axial bearing being required.

The fluid-injected screw-type compressor element according to the invention is preferably provided with means to restrict the axial play on the outlet side between the rotors 2 and 3 and the housing 1.

To that end, opposite the crosscut far end of the axle journal 14 on the inlet side of the compressor element is formed a closed chamber 19 in an end part 18 of the housing 1 in this case, which is connected to the fluid line 10 via a branch 20, and thus to the part of the fluid circuit 11 in which a lower pressure than the outlet pressure prevails, such that, while the compressor element is operational, a pressure will be exerted on the crosscut far end of said axle journal 14.

In an analogous way, a closed chamber 21 is formed in the end part 18 of the housing 1, opposite the crosscut end of the body 12 of the female rotor 2 on the inlet side of the compressor element, which chamber 21 is connected to the fluid line 10 via a branch 22, and thus to the part of the fluid circuit 11 in which a pressure prevails which is practically equal to the outlet pressure, such that, while the compressor element is operational, a pressure will be exerted on this crosscut end of the rotor 2 as well.

In the given example, the axle journal 15 of the male rotor 3 is extended to outside the housing 1 where it can be coupled to a drive such as a motor or the like, not represented in FIG. 1.

The female rotor 2 is in this cage not connected to said drive, but it is directly driven by the male rotor 3.

According to the invention, however, it is also possible to provide only the female rotor 2 with an axle journal which extends to outside the housing 1 and which is coupled to a drive, such that the male rotor 3 is driven by the female rotor 2.

According to a preferred characteristic of the invention, the fluid-injected screw-type compressor element comprises provisions to restrict any friction between the mutual rotors 2 and 3 and between the rotors 2 and 3 and the housing 1, which provisions, according to a preferred aspect of the invention, contain a hard, practically frictionless coating provided over at least a part of the surface of one or both rotors 2 and 3 and/or at least a part of the wall of the housing 1.

In particular, the aforesaid coating can be provided over at least a part of one or several of the following surfaces:

- an end face of at least one of the rotors 2 and 3;
- a contact surface of at least one of the rotors 2 and 3, whereby by a "contact surface" is meant, a collection of points on the surface of a rotor, which points, while the screw-type compressor element is operational, make contact with the rotor co-operating with the latter;
- a part of the wall of the housing 1 opposite an aforesaid end face of a rotor 2 or 3;
- a part of the wall of the housing 1 opposite the radial perimeter of an aforesaid rotor 2 or 3.

The aforesaid coating may for example consist of what is called a "diamond like carbon" coating (DLC coating), but it can also be made in the form of another coating such as a "Near Frictionless Carbon" coating (NFC coating), a ceramic coating, a metallic coating, a polymer coating or the like.

The aforesaid coatings may be either or not doped with micro particles and/or nano particles of hard and/or lubricating types of fillers.

According to a special aspect of the invention, the fluid which is injected in the rotor chamber 4 via the openings 10A and 10B consists of a cooling liquid with a very low viscosity (e.g. a mineral oil), or in other words a cooling liquid whose kinematic viscosity is considerably lower at 40° C. than that of the present oil-injected compressors ($6 \cdot 10^{-6}$ $m^2/s$), which liquid, in co-operation with the aforesaid coating, causes a tribological effect between the mutual rotors 2 and 3 and/or between the rotors 2 and 3 and the housing 1, so that, despite the very low viscosity, a lubricating and sealing effect is nevertheless obtained during every operational condition of the screw-type compressor element.

Consequently, the injected fluid must only consist of a cooling liquid and it must not have any sealing or lubricating qualities as such.

Thanks to an appropriate application of the provisions for restricting any friction between the rotors 2 and 3, and between the rotors 2 and 3 and the housing 1, which in this case means an appropriate dimensioning of the coated parts and applying the appropriate combination of coating and cooling liquid, at least one of the rotors 2 and/or 3 on at least one axial rotor end will be free of radial bearings, and in particular on at least one axial rotor end it will be free of an axle journal 14-15.

Another preferred additional measure to reduce any friction between the mutual rotors 2 and 3 and between the rotors 2 and 3 and the housing 1 consists in the characteristic that one or both rotors and/or the wall of the housing 1 is provided with a relief over at least a part of its surface so as to provide for a morphology with practically frictionless behaviour.

To this end, a texture can be burnt in the surface concerned by means of a laser; the surface concerned can be processed by means of sand-blasting, honing, lapping or grinding or any other surface treatment technique whatsoever.

Such a relief is preferably provided at least on the surfaces that are free of any coating, but this is not strictly necessary according to the invention and, consequently, such a coating may also be provided on a surface which is coated afterwards with an aforesaid practically frictionless coating.

In particular, the aforesaid relief can be provided on at least a part of one or several of the following surfaces:

an end face of at least one of the rotors 2 and 3;

a contact surface of at least one of the rotors 2 and 3;

a part of the wall of the housing 1 opposite an aforesaid end face of a rotor 2 or 3;

a part of the wall of the housing 1 opposite the radial perimeter of an aforesaid rotor 2 or 3.

The practically frictionless contact between the aforesaid tribological surfaces and the distribution of the bearing-load over a considerably larger area than in the case of for example roller bearings will lead to a considerable reduction of the transfer of peak loads on the housing 1. A considerable reduction of the vibro-acoustic noise emission of the screw-type compressor element is thereby moreover obtained as well.

Thanks to the presence of the chambers 19 and 21, an axial pressure is created on the inlet side on the crosscut far end of the axle journal 14 and the end face of the female rotor 2 respectively, which pressure counteracts the axial forces which are exerted on the rotors 2 and 3 by the compressed gas.

The invention is by no means restricted to the embodiments described by way of example and represented in the accompanying drawings; on the contrary, such a fluid-injected screw-type compressor element can be made in all sorts of shapes and dimensions while still remaining within the scope of the invention.

The invention claimed is:

1. A fluid-injected screw-type compressor element comprising:

two co-operating rotors wherein at least a first rotor of the two co-operating rotors is radially and axially bearing-mounted in a housing;

said housing defining a rotor chamber having chamber walls in which the two co-operating rotors are located and in which a fluid circuit for the circulation of a fluid is provided; and means for restricting friction between at least one of the two co-operating rotors and the chamber walls, wherein at least a second rotor of the at least two co-operating rotors is configured to be radially aligned by at least one of the contact of the second rotor with a part of the wall of the chamber opposite a radial perimeter of the second rotor and a co-operation with the first rotor, wherein said means for restricting friction comprises a hard frictionless coating or a relief that provides a morphology with frictionless behavior, said coating or relief being provided over at least an end face of the second rotor so that said second rotor is free of axial bearings, and wherein at least one rotor on at least one or on both axial rotor ends is free of a bearing-mounted axle journal.

2. The fluid-injected screw-type compressor element according to claim 1, wherein the second rotor is free of any radial bearings.

3. The fluid-injected screw-type compressor element according to claim 1, wherein the axial alignment of the second rotor is formed by contact between the end face of the second rotor and a corresponding part of the wall of the chamber, without any axial bearing being provided.

4. The fluid-injected screw-type compressor element according to claim 1, wherein the means for restricting friction also restricts friction between the mutual rotors.

5. The fluid-injected screw-type compressor element according to claim 4, wherein said hard, frictionless coating is also provided over at least a part of the surface of one or both rotors and/or at least a part of the wall of the chamber.

6. The fluid-injected screw-type compressor element according to claim 1, wherein the coating comprises a DLC coating, an NFC coating, a ceramic coating, a metallic coating or a polymer coating.

7. The fluid-injected screw-type compressor element according to claim 5, wherein the coating is also provided over at least a part of one or several of the following surfaces:

a contact surface of at least one of the rotors;

a part of the wall of the chamber opposite an end face of a rotor; and a part of the wall of the chamber opposite the radial perimeter of the rotor.

8. The fluid-injected screw-type compressor element according to claim 1, wherein the kinematic viscosity of the fluid at 40° C. is lower than $6 \cdot 10^{-6}$ $m^2/s$.

9. The fluid-injected screw-type compressor element according to claim 1, wherein the fluid is selected such that, in co-operation with the coating, it produces a tribological effect, resulting in a low friction contact between the mutual rotors and/or between the rotors and the chamber walls.

10. The fluid-injected screw-type compressor element according to claim 1, wherein the relief is formed of a texture which has been laser burnt in the surface concerned, or which has been provided therein by means of sand-blasting, honing, lapping or grinding or by means of chemical methods.

11. The fluid-injected screw-type compressor element according to claim 1, wherein the relief is provided over at least a part of one or several of the following surfaces:

a contact surface of at least one of the rotors;

a part of the wall of the chamber opposite an end face of a rotor; and a part of the wall of the chamber opposite the radial perimeter of a rotor.

12. The fluid-injected screw-type compressor element according to claim 1, including means to restrict play between the rotors and the rotor chamber, said means to restrict play comprising a second chamber provided on the inlet side of the screw-type compressor element, opposite an end face of a rotor body and/or opposite a crosscut far end of an axle journal of a rotor.

13. The fluid-injected screw-type compressor element according, to claim 12, wherein the second chamber is connected to a fluid line via a branch, said fluid line being connected to a fluid separator in an outlet line of the screw-type compressor element.

14. The fluid-injected screw-type compressor element according to claim 1, wherein the second rotor is configured to be radially aligned using only one radial bearing on the axle journal.

15. A fluid-injected screw-type compressor element comprising:

two co-operating rotors wherein at least a first rotor of the two co-operating rotors is radially and axially bearing-mounted in a housing;

said housing defining a rotor chamber having chamber walls in which the two co-operating rotors are located and in which a fluid circuit for the circulation of a fluid is provided; and means for restricting friction between at least one of the two co-operating rotors and the chamber walls, wherein at least a second rotor of the at least two co-operating rotors is configured to be radially aligned by at least one of the contact of the second rotor with a part of the wall of the chamber opposite a radial perimeter of the second rotor and a co-operation with the first rotor, wherein said means for restricting friction comprises a hard, frictionless coating or a relief that provides a morphology with frictionless behavior, said coating or relief being provided over at least an end face of the second rotor so that said second rotor is free of axial bearings, and wherein on at least one or on both axial rotor ends of the second rotor, the rotor end is free of a bearing-mounted axle journal.

* * * * *